US007057140B2

(12) United States Patent
Pittman

(10) Patent No.: US 7,057,140 B2
(45) Date of Patent: Jun. 6, 2006

(54) WATER HEATER

(75) Inventor: Robert Pittman, Melbourne, FL (US)

(73) Assignee: Balboa Instruments, Inc., Tustin, CA (US)

( * ) Notice: Subject to any disclaimer, the term of this patent is extended or adjusted under 35 U.S.C. 154(b) by 252 days.

(21) Appl. No.: 09/896,969

(22) Filed: Jun. 29, 2001

(65) Prior Publication Data

US 2002/0000007 A1 Jan. 3, 2002

Related U.S. Application Data

(60) Provisional application No. 60/215,636, filed on Jun. 30, 2000.

(51) Int. Cl.
*H05B 1/02* (2006.01)

(52) U.S. Cl. ..... 219/481; 219/497; 392/465; 392/485

(58) Field of Classification Search ..... 219/497, 219/481, 505, 501, 483–486, 494, 506; 392/460–480, 392/485, 498
See application file for complete search history.

(56) References Cited

U.S. PATENT DOCUMENTS

| | | | | |
|---|---|---|---|---|
| 3,791,863 | A * | 2/1974 | Quirk | 219/543 |
| 4,150,665 | A | 4/1979 | Wolfson | |
| 4,381,031 | A | 4/1983 | Whitaker et al. | |
| 4,529,033 | A | 7/1985 | Blum | |
| 5,172,754 | A | 12/1992 | Graber et al. | |
| 5,199,116 | A | 4/1993 | Fischer | |
| 5,318,007 | A | 6/1994 | Afshar | |
| 5,325,822 | A * | 7/1994 | Fernandez | 392/491 |
| 5,361,215 | A | 11/1994 | Tompkins et al. | |
| 5,415,221 | A | 5/1995 | Zakryk | |
| 5,434,388 | A | 7/1995 | Kralik et al. | |
| 5,438,712 | A | 8/1995 | Hubenthal | |
| 5,557,704 | A | 9/1996 | Dennis et al. | |

(Continued)

FOREIGN PATENT DOCUMENTS

| | | |
|---|---|---|
| DE | 3925549 | 2/1991 |

(Continued)

OTHER PUBLICATIONS

Kloppers, G.J., PEMS—Dickschicht—Heizelemente auf Email Mitteilungen Des Vereins Deutscher Emailfachleute E.V., Band 43/95, Seite 77-88, Jun. 6, 1995.

*Primary Examiner*—Mark Paschall
(74) *Attorney, Agent, or Firm*—Larry K. Roberts

(57) ABSTRACT

An improved water heater for use in spas, hot tubs, pools, hydrotherapy pools, bath tubs, and similar bodies of water used indoors, outdoors, or both indoors and outdoors are used for both therapeutic and recreational purposes. The water heater uses heating element technology know as thick film on substrate comprising resistive elements bonded to the outer dry surface of a substrate to heat the substrate which in turn heats the water flowing through the heating chamber. The heater is highly efficient due to the direct contact of the wet heating surface with the water and provides a smooth seamless inner heating surface by eliminating the need to pass electrical leads into the wet region of the heater. This virtually eliminates the risk of leaks in the water heater due to bulkhead fittings. The invention further eliminates the need for a heating element to be contained in the inner wet region of a spa heater, thereby reducing the risk of corrosion. The water heater can be used with electrical, electro-mechanical, and mechanical control systems for spas and can be retrofitted into existing spa applications.

36 Claims, 4 Drawing Sheets

U.S. PATENT DOCUMENTS

| | | | | |
|---|---|---|---|---|
| 5,724,478 | A | 3/1998 | Thweatt | |
| 5,872,890 | A | 2/1999 | LaCombe | |
| 5,933,575 | A | 8/1999 | Sanders | |
| 5,946,927 | A | 9/1999 | Dieckmann et al. | |
| D415,264 | S | 10/1999 | Thweatt, Jr. | |
| 5,968,393 | A | 10/1999 | Demaline | |
| 5,978,550 | A | 11/1999 | Rochelle | |
| 6,080,973 | A | 6/2000 | Thweatt, Jr. | |
| 6,154,608 | A | 11/2000 | Rochelle | |
| 6,212,894 | B1 | 4/2001 | Brown | |
| 6,342,997 | B1 | 1/2002 | Khadkikar et al. | |
| 6,459,854 | B1 * | 10/2002 | Yoakim et al. | 392/479 |
| 6,590,188 | B1 * | 7/2003 | Cline et al. | 219/497 |

FOREIGN PATENT DOCUMENTS

| | | |
|---|---|---|
| EP | 0 485 211 B1 | 6/1997 |
| GB | 2305233 | 4/1997 |

* cited by examiner

WATER HEATER

CROSS-REFERENCE TO RELATED APPLICATIONS

This application claims the benefit of U.S. Provisional Patent Application No. 60/215,636 filed Jun. 30, 2000, the entire contents of which are incorporated herein by this reference.

FIELD OF THE INVENTION

The present invention relates generally to water heaters and methods of heating water in spas, hot tubs, pools, hydrotherapy pools, bath tubs, and similar bodies of water, and more particularly, to new uses of a heating element constructed of a thick film resistive layer on a substrate technology applied to water heaters.

BACKGROUND OF THE INVENTION

Spas, hot tubs, pools, hydrotherapy pools, bath tubs, and similar bodies of water used indoors, outdoors, or both indoors and outdoors are used for both therapeutic and recreational purposes (all forms of the aforementioned and derivatives thereof are referred to hereinafter as "spas"). When used for these purposes, the spa water is typically heated from ambient temperature to a desired temperature of approximately 90 to 120 degrees Fahrenheit. Because spas contain a large amount of water that must be heated rather rapidly, various types of water heaters have been used. Due to extensive building safety code regulations and high initial setup costs for gas heating water for spas, the majority of spas use heaters that employ electric heat in some form or fashion.

Recent trends in the industry have been to use one of three general methods to electrically heat spa water. The first method is to have an electrical heating element in the piping system or in an enlarged portion of the piping system to heat the water as it flows through the pipe and comes into contact with the heating element. Examples of this heating method are disclosed in U.S. Pat. No. 5,978,550, issued Nov. 2, 1999, invented by Rochelle, entitled WATER HEATING ELEMENT WITH ENCAPSULATED BULKHEAD; U.S. Pat. No. 5,438,712, issued Aug. 8, 1995, invented by Hubenthal, entitled HOT TUB HEATER SYSTEM; and U.S. Pat. No. 6,080,973, issued Jun. 27, 2000, invented by Thweatt, entitled ELECTRIC WATER HEATER. These are very efficient methods of heating spa water due to the heating element being surrounded by spa water, which dissipates the majority of heat produced into the spa water. However, the reason for this method's efficiency is also the reason for its frequent failure and need for repairs. Because the heating element is surrounded by chemically treated water at high temperatures, the heating element is subject to various types of corrosion, including: galvanic corrosion, chemical pitting, intergranular corrosion, stress corrosion cracking, corrosion fatigue, electrochemical corrosion, and bacterial corrosion due to Ferrobacillus bacteria. This corrosion exposure is one of the most common and most frequent causes of spa breakdown, which generally requires a costly repair due to pipes needing to be cut to expose the heating element, or replacement of the entire heater apparatus. Furthermore, this method is prone to leaks and failures due to the need for bulkheads to allow the electric line(s) to pass from the outer-dry surface to the inner-wet surface, so the heating element can be surrounded by the water that is to be heated. The bulkheads are another common source of failure in spa heaters, which make them susceptible to leaks and water intrusion.

The second method of heating spa water is to have an electrical heating element wrapped or looped around the outside of a section of spa water flow pipe to heat the pipe, which in turn, heats the water flowing through that particular section of pipe. Although this method eliminates the need for bulkheads and electrical lines passing through the water retaining surface, this method provides a very inefficient means of heating water due to the minimal amount of surface area contact between the heating element loops and the flow pipe, resulting in most of the heat being dissipated to the surrounding air or insulation. An example of a device that employs this method of heating spa water is disclosed in U.S. Pat. No. 5,434,388, issued Jul. 18, 1995, invented by Kralik et al., entitled ELECTRICAL HEATER FOR MEDIA, PARTICULARLY FLOW HEATER. The '388 Patent discloses a foil or film-like electrical insulation comprising a plastic film or sheet of high temperature-resistant polymide, provided between the hollow body wall and the heating element. The foil insulation adheres to the wall of the heater by pretensions of a heating element thereby creating an elasticity reserve for thermal expansion. Thus, this device discloses an external insulating/heating device that is wrapped around a heater tube.

An example of a variant of the second type of heating method is disclosed in U.S. Pat. No. 5,172,754, issued Dec. 22, 1992, invented by Graber et al., entitled HEAT EXCHANGER FOR RECOVERY HEAT FROM A SPA OR HOT TUB PUMP MOTOR. The '754 patent is a slight variation in that a small flow tube is looped around the water pump motor to capture the heat produced by the pump motor and transfer the heat to the water flowing through the flow tube. This method is inefficient due to minimal contact area between the water and the heating surface.

Other variants on this theme are disclosed in U.S. Pat. No. 5,415,221, issued May 16, 1995, invented by Zakryk, entitled AUTO SWITCHING SWING POOL/SPA HEATER SYSTEM; U.S. Pat. No. 5,199,116, issued Apr. 6, 1993, invented by Fischer, entitled HIGH-EFFICIENCY PORTABLE SPA; and U.S. Design Patent No. D415,264, issued Oct. 12, 1999, invented by Thweatt, entitled WATER HEATER.

The third method of heating spa water is by providing an elongated heat conductive member constructed of a solid heat conductive material, with water passageways equally spaced about a central axis. An elongated electrical heating element runs along the central axis of the heat conductor member, which radiates heat to the elongated heat conductive member, which in turn radiates heat to the water passageways to heat the water flowing there through. An example of this type of heating method is disclosed in U.S. Pat. No. 5,724,478, issued Mar. 3, 1998, invented by Thweatt, entitled LIQUID HEATER ASSEMBLY. This method of heating spa water is inefficient due to the distance between the heating element and the water passageways, and the amount of solid heat conductive material that must be heated in order for heat to radiate to the water flowing through the water passageways. Furthermore, this method is very expensive to manufacture and requires strict dimensional and bore tolerances to maximize the surface contact area to transfer as much heat as possible from the heating element to the flow pipes. The repair cost for this system can be quite costly as well due to the elaborate piping through a solid aluminum conductive member. A similar device for heating spa water is disclosed in U.S. Pat. No. 6,154,608, issued Nov. 28, 2000, invented by Rochelle, entitled DRY ELEMENT WATER HEATER.

Other relevant devices and methods for heating spa water are disclosed in U.S. Pat. No. 4,529,033, issued Jul. 16, 1985, invented by Blum, entitled HOT TUB HEATING SYSTEM; U.S. Pat. No. 4,150,665, issued Apr. 24, 1979, invented by Wolfson, entitled HEATER FOR HOT TUBS AND STORAGE TANKS; U.S. Pat. No. 4,381,031, issued Apr. 26, 1983, invented by Whitaker et al., entitled SPA-DOMESTIC HOT WATER HEAT EXCHANGER; and U.S. Pat. No. 5,946,927, issued Sep. 7, 1999, invented by Dieckmann et al., entitled HEAT PUMP WATER HEATER AND STORAGE TANK ASSEMBLY.

Accordingly, there is a substantial need in the art for improved spa heater devices that: (1) provide efficient heating of spa water by direct contact of the heating element with the spa water; (2) provide a smooth seamless inner heating surface without the need to pass electrical leads into the wet region of the heater, thereby eliminating the need for bulkhead fittings and reducing the risk of leaks; (3) do not expose the heating elements to high temperature, chemically treated water, thereby eliminating the risk of corrosion; (4) is made by fusing and bonding components together without welds and seams, thereby reducing seam leaks and fatigue stress cracks; (5) are easy and inexpensive to manufacture; (6) can be used with electrical, electromechanical, and mechanical control systems for spas; and (7) can be retrofitted into existing spa applications.

SUMMARY OF THE INVENTION

The present invention specifically addresses and alleviates the above mentioned deficiencies associated with the prior art. In this regard, the present invention comprises a new and improved use of a heating element technology known as "thick film on substrate construction," applied to a spa heater. The thick film on substrate heating element comprises an electrical resistance layer of material affixed to a substrate, which can be a plate or pipe made of metallic material such as stainless steel. Electricity is passed to the resistive layer by an electrical lead terminal on the outside of the substrate plate or pipe, which eliminates the need for bulkhead fittings to pass electrical charge into the inner surface or wet region of the spa heater. This invention also eliminates the risk of leaks and busted fittings by providing a smooth inner heating surface with no bulkheads and no electric current passing through the wall into the wet region of the heater. By eliminating passing electricity into the wet region, the risk of corrosion of the heating element is eliminated. Temperature sensors such as thermistors are also attached directly to the substrate for monitoring the temperature and providing temperature data to a power controlling device. Other temperature sensing devices can be used instead of or in conjunction with thermistors. Alternatively, temperature sensors can be passed into the water flow path at locations near the heater to get direct water temperature readings without the need to replace the heater if a temperature sensor should fail or develop a leak. A glass or other insulating material overcoating can be applied to the top of the resistive and conductive elements to provide further insulation and protection from other environmental factors.

According to an embodiment of the invention, the thick film on substrate heating elements are in the form of plates coupled to a heating chamber with inflow and outflow pipes attached to the heating chamber to allow water to enter the heating chamber. This arrangement provides a smooth seamless inner heating surface without the need to pass electrical leads into the wet region of the heater. Such arrangement further eliminates the need for bulkhead fittings and prevents corrosion of the heating element by maintaining a physical barrier between the "dry" electrical portion of the heater and the "wet" water flow portion of the heater. An electrical line is connected to the conductive layer and resistors to energize the system and heat the substrate, which is in direct contact with the spa water to be heated. This smooth surface direct contact between the spa water to be heated and the heating element or substrate provides efficient heat transfer to the spa water due to the large surface area of interaction between the substrate and the spa water. An added benefit of not having bulkhead fittings and a heating element in the water flow path is that there is no reduction in flow rate due to obstructions within the water flow path.

Another embodiment of the present invention discloses the resistive layer being bonded directly onto a portion of one or more walls of the heating chamber without the need for any enlargement and reduction pipes. As a variant, the resistive layer may be in the form of an electrically conductive mat, fabric, or mesh that is adhered to one or more walls of the heating chamber. In either embodiment, the dimensions and layout of the resistive layer can be calculated on the basis of the surface area of the heating chamber walls and the necessary temperature to be maintained for a certain flow of water through the heating chamber. Temperature sensors such as thermistors are attached to the resistive material or substrate to provide temperature data to a power controlling device. Other temperature sensing devices can be used instead of or in conjunction with thermistors.

Another embodiment of the present invention discloses the resistive layer being bonded directly onto a substrate which is one or more walls of the heating chamber that is metal, and the remaining section of pipe being plastic, polyvinyl chloride, or other comparable material.

Another embodiment of the present invention discloses the heating element built into the wet end of a water pump for circulating water through a system.

Another embodiment of the present invention discloses the use of multiple spa heaters in series to increase the amount of heat provided without necessarily increasing the size of a single spa heater.

Another embodiment of the present invention discloses a spa heater that can be retrofitted to an existing spa system that uses gas or electrical heating or a combination of both.

Another embodiment of the present invention discloses a heater that can be used on spa systems that have electrical, electromechanical, and mechanical control systems.

Other features and advantages of the invention will become apparent from the following detailed description, taken in conjunction with the accompanying drawings, which illustrate, by way of example, various features of embodiments of the invention.

BRIEF DESCRIPTION OF THE DRAWINGS

These as well as other features of the present invention will become more apparent upon reference to the accompanying drawings wherein like numerals designate corresponding parts in the several figures.

DETAILED DESCRIPTION OF THE PREFERRED EMBODIMENTS

The following detailed description and accompanying drawings are provided for purposes of illustrating and describing presently preferred embodiments of the invention and are not intended to limit the scope of the invention in any way. It will be recognized that further embodiments of the invention may be used.

Figure 1:
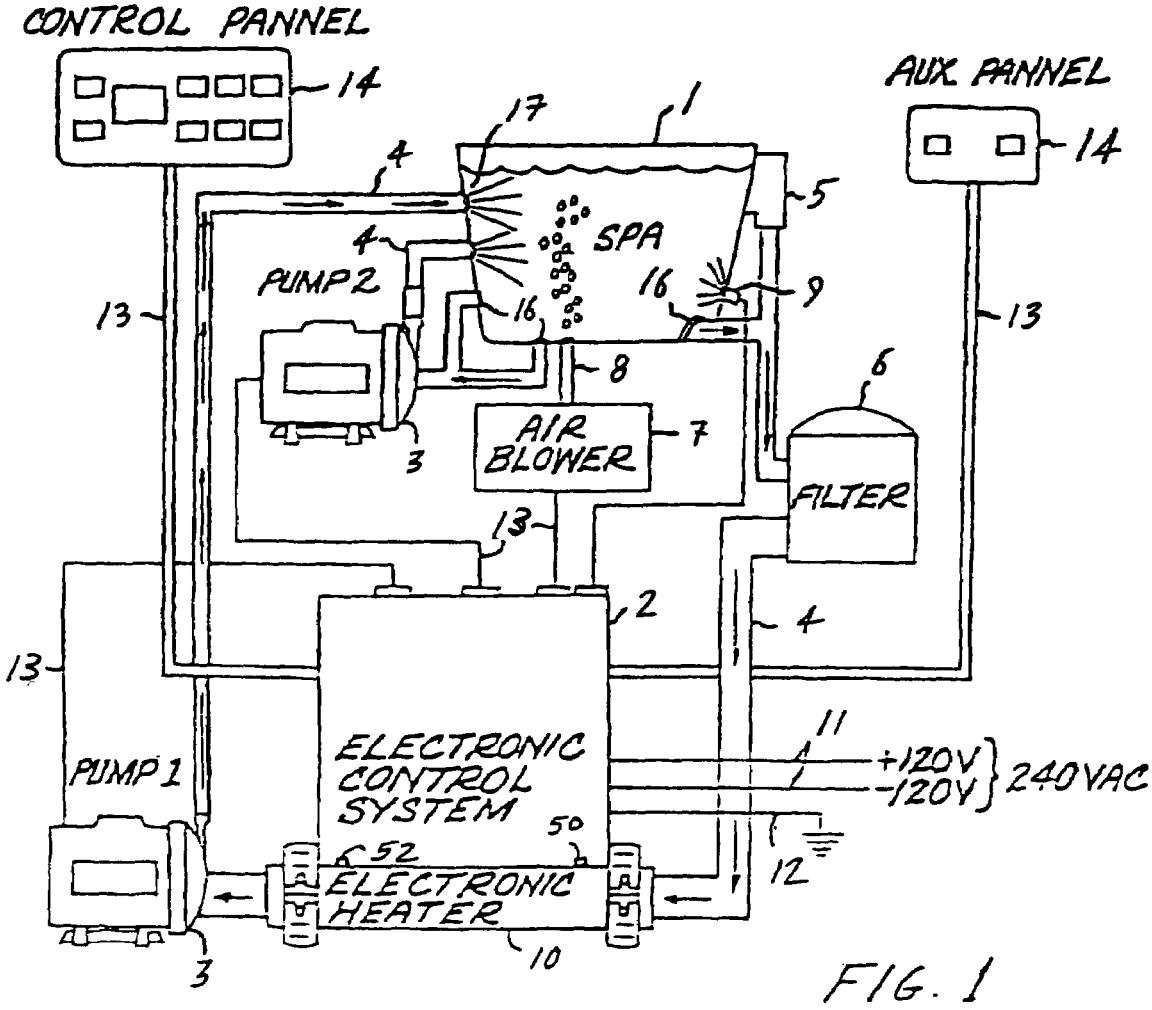
FIG. 1 is a block diagram of a spa system with typical equipment and plumbing.

Referring now to the drawings wherein FIG. 1 is a diagram of a spa system showing the spa heater 10 with typical equipment and plumbing installed. The system includes a vessel for holding water 1 and a control system 2 with one or more microprocessors 58 to activate and manage various spa components and adjust and maintain various parameters of the spa. Connected to the vessel for holding water 1 through a series of plumbing lines 4 are one or more pumps 3 for pumping water, a skimmer 5 for cleaning the surface of the spa, a filter 6 for removing particulate impurities in the water, an air blower 7 for delivering therapeutic bubbles to the spa through one or more air pipes 8, and a spa heater apparatus 10 for maintaining the temperature set by the user. A light 9 is provided for internal illumination of the water.

Service voltage power is supplied to the spa control system 2 by electrical service wiring 11, which can be 120V or 240V single phase 60 cycle, 220V single phase 50 cycle, or any other generally accepted power service suitable for commercial or residential service. An earth ground 12 is connected to the control system 2 and therethrough to all metal parts and all electrical components that carry service voltage power and all metal parts. The spa control system 2 with one or more microprocessors 58 is electrically connected through cables 13 and/or cables in conduit to one or more control panels 14. All components powered by the control system are connected by cables 13 and/or cables in conduit suitable for carrying appropriate levels of voltage and current to properly operate the spa.

Water is drawn to the plumbing system generally through the skimmer 5 or suction fittings 16, and discharged back into the spa through therapy jets 17. Temperature sensing devices 50 and 52 such as thermistors are typically located throughout the system to provide temperature data to the spa control system 2.

Figure 2:
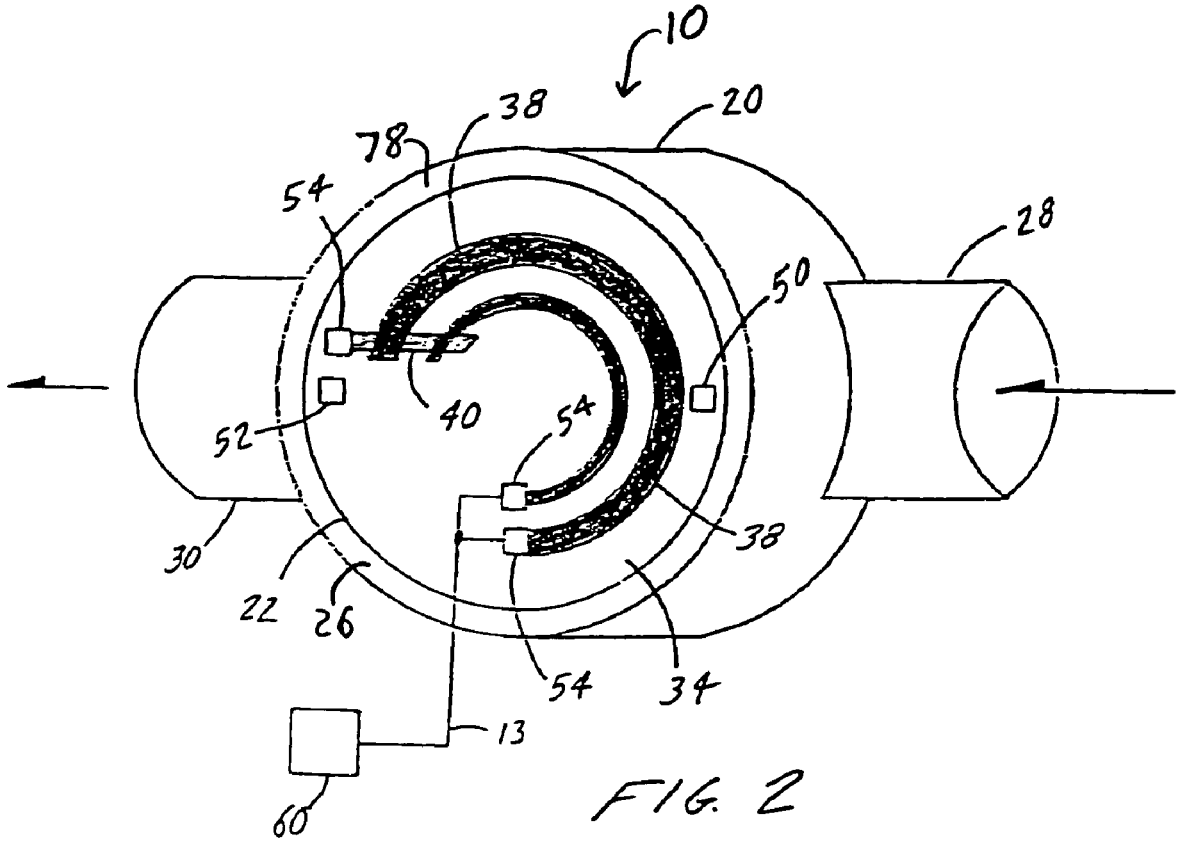
FIG. 2 is a perspective view of an embodiment of the water heater.

FIG. 2 shows a perspective view of an alternate embodiment of the water heater 10 for use in spas, hot tubs, pools, hydrotherapy pools, bath tubs, and similar bodies of water that can be used indoors, outdoor or both. The water heater 10 has a heating chamber 20 connected in a water flow path to heat the water flowing through the chamber. The heating chamber 20 has an inlet pipe 28 and an outlet pipe 30 for connecting the heater to a spa's plumbing lines.

The embodiment shown has two circular thick film on substrate heaters with heating surfaces 22 to form two of the walls of the heating chamber. The heating surfaces have an inner wet surface 24 (shown in FIG. 4) to contact the water to be heated, and an outer dry surface 26 for maintaining all of the electrical connections. The configuration of the heating chamber provides seamless inner heating surfaces with maximum heater water interaction to efficiently heat the water to desired temperatures.

Figure 3:
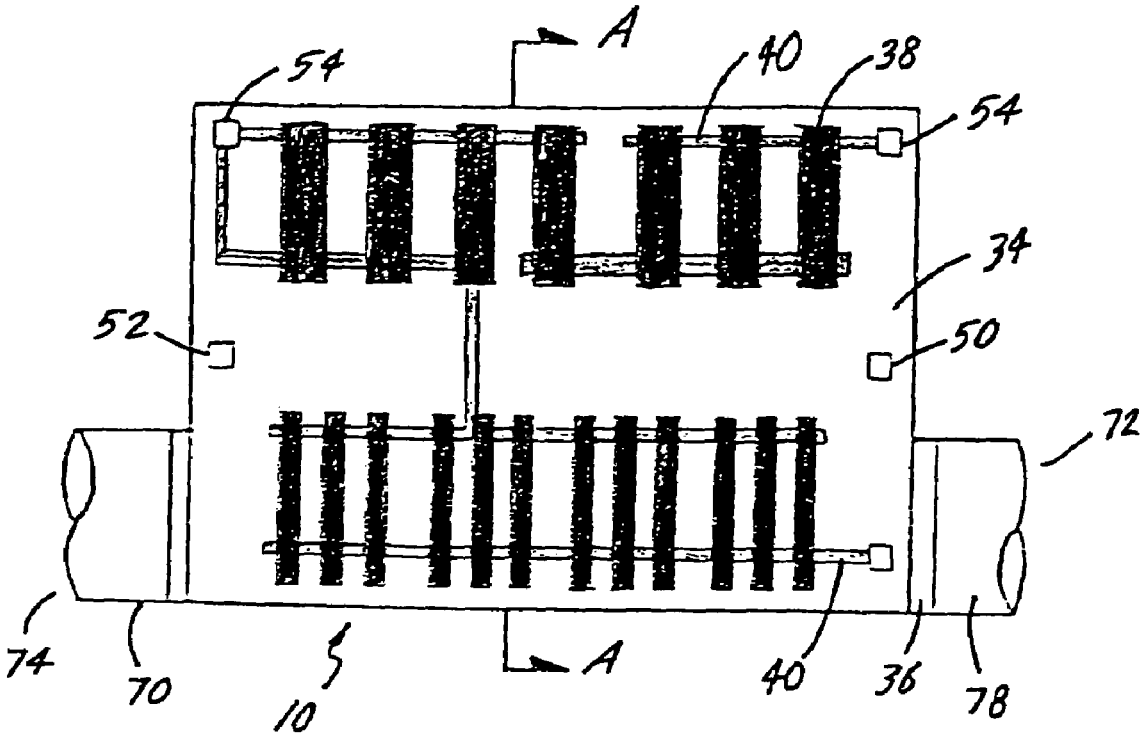
FIG. 3 is a top plan view of the water heater showing a pipe used for the heating chamber wherein the pipe is cut lengthwise and unrolled to show a representative layout of the resistors.
Figure 4:
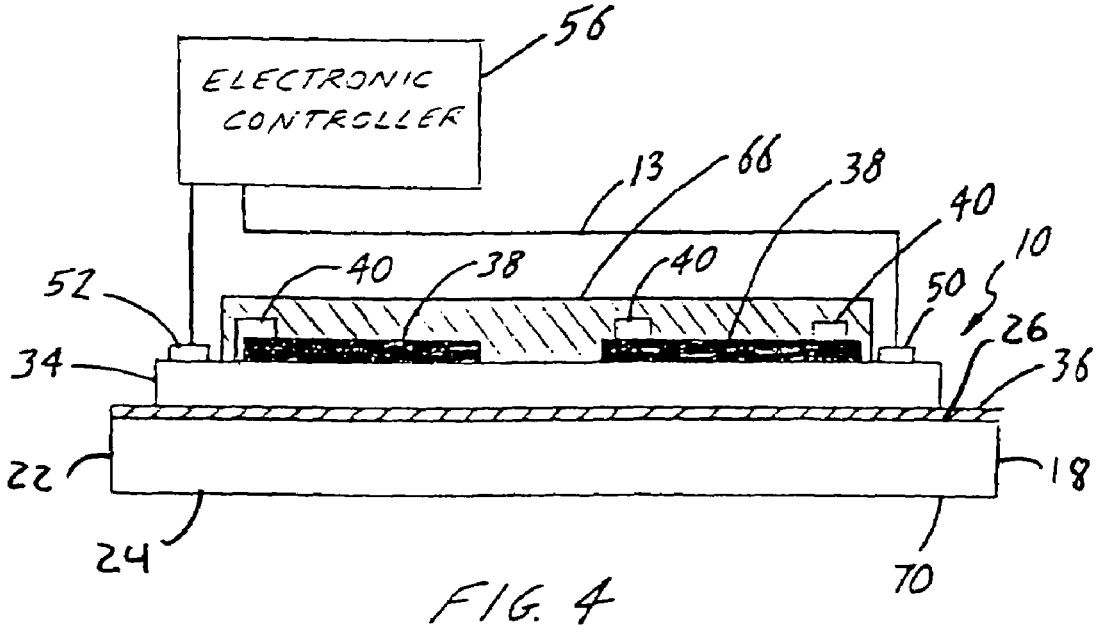
FIG. 4 is a partial section view along lines A—A of FIG. 3.

The heating surface 22 has a substrate 18, which is preferably stainless steel that has been preheated to form a chromium oxide binder 36 on the outer surface for coupling a dielectric layer 34 thereon (shown in FIG. 4). The material that the heating chamber walls for heating surfaces consist of is preferably made of stainless steel, but it is understood that the pipe material can be any other suitable material which is resistant to known changes in water chemistry of spas, hot tubs, pools, hydrotherapy pools, bath tubs, and similar bodies of water used indoors, outdoors, or both indoors and outdoors. A binding material 36 is formed on the outer surface of the heating surface 22 to bind a dielectric layer 34 to the outside of the heating chamber 20 which, in an exemplary embodiment may be a pipe 70, as shown in FIG. 3. The preferred embodiment uses preheated stainless steel as the material for the heating surface 22. When the stainless steel is preheated, a chromium oxide coating is formed on the outer surface 78, which acts as the binding material 36 to allow the dielectric layer 34 to be attached thereto.

A plurality of resistors 38 are attached to the dielectric layer 34 and are connected by a conductive layer 40, which is connected by terminals 54 to the power controlling device 68 (shown in FIG. 5) and power supply 60 to controllably energize the water heater 10. Temperature sensors 50 and 52 are located on the heater 10 for sensing temperature and providing temperature data to the power controlling device 68. The plurality of terminals 54 are connected to the conductive layer 40 for connecting wires from the power controlling device 68, which is also adapted to process signals from a plurality of devices providing water parameter information such as temperature, pH, and the presence or absence of water within the heater 10. The power controlling device 68 is arranged to control the operation of the water heater by regulating the temperature and controllably energizing the water heater 10.

Figure 5:
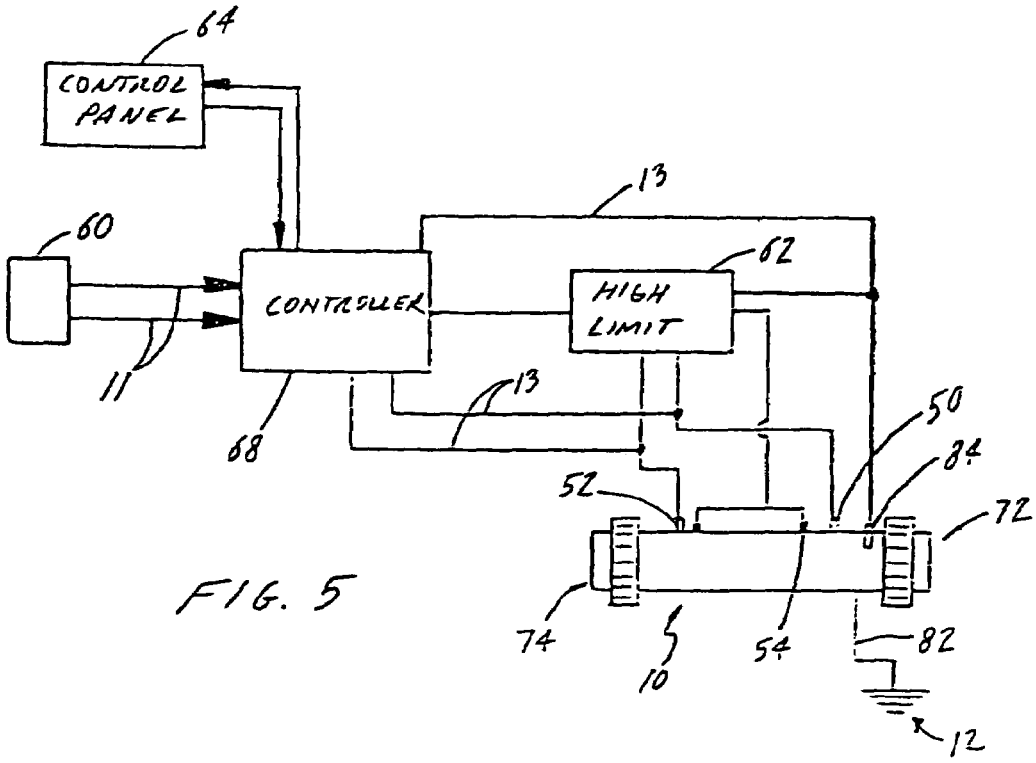
FIG. 5 is a block diagram showing the connections of the water heater to various control mechanisms of an embodiment with standard spa controls.

As further shown in FIG. 2, temperature sensors 50 and 52 are located on the surface of the heating surface 22, to provide temperature data to the electronic controller 56 and to a separate high limit switch 62 (more readily seen in FIG. 5). The terminals 54 for coupling cables 13 from the various controls and sensors to the conductive layer 40 can be multi-strand percussion welds or other methods of attachment well-known in the art, for example a stud welded onto the conductive layer.

By maintaining all electrical elements of the heater on the outer surface 78 of the heater 10, virtually all of the typical failures associated with traditional spa heaters are eliminated. The result is a smooth seamless inner heating surface without the need to pass electrical leads into the inner wet region of the heater, thereby eliminating the need for bulkhead fittings and reducing the risk of leaks. Additionally, there are no heating elements exposed to high temperature chemically treated water, which eliminates the risk of corrosion.

FIG. 3 shows a top plan view of the heater 10 showing the heating chamber as a pipe 70 cut lengthwise and unrolled to show the layout of the resistors 38, the dielectric layer 34,and the conductive layer 40. The dimensions and layout of the dielectric layer 34, resistors 38, conductive layer 40, and the terminals 54 are configured to provide variable operating resistance values.

The pattern of resistors 38 and conductive layer or conductive strips 40 are preferably screen-printed onto the binding material 36, however, the same pattern or layout can be configured onto the binding material 36 and heating surfaces 22 (shown in FIG. 4) by various other methods such as depositing an electrically conductive composition onto the binding material, bonding, or electrostatic spraying with the use of a stencil.

FIG. 4 is a section view along lines A—A of FIG. 3 showing the cross-section of the heater 10. The bottom layer is the heating chamber wall or heating surface 22, which has the binding material 36 to enable the dielectric layer 34 to adhere to the outer dry surface 26 of the heating chamber wall. The pattern of resistors 38 is screen-printed onto the dielectric layer 34 and the conductive layer 40 electrically connects the resistors 38 to the power supply 60 (shown in FIG. 5) and controller 56 through the terminals 54 (shown in FIG. 3) to form an electrical circuit for energizing the heater 10. In the embodiment shown in FIG. 4, there is shown an insulating overcoat 66, preferably of a glass insulating material covering the dielectric layer 34, the resistors 38, and the conductive layer 40 to provide thermal insulation and to provide scratch protection for the various layers.

FIG. 5 is a block diagram showing the interconnectivity of the water heater 10 to the power supply 60 and to traditional spa heater control mechanisms. Electrical service wiring is connected to the power controlling device 68, which is connected in series to a high limit switch 62. The high limit switch 62 is connected to at least one temperature sensor 50 to cause power to be disconnected from the water heater when the temperature exceeds a predetermined temperature. The preferred embodiment has two temperature sensors 50 and 52, both connected to the power controlling device 68 and the high limit switch 62. A grounding connection 82 is also connected to the heater 10 to ground the device. When only one temperature sensor is employed the preferred location of the temperature sensor is at near the outlet 74 of the water heater 10. The high limit switch 62 preferably automatically reconnects the power to water heater once the temperature has dropped below a predetermined temperature. A manual reset can also be used to reconnect the power to the heater. The high limit switch can employ either electric circuitry or mechanical means.

The power controlling device 68 is also connected to the temperature sensors 50 and 52, to the power supply 60, to a water presence sensor 84, which is located on or near the heater 10, and to a control panel 64 for inputting user preferences. The power controlling device 68 receives temperature data from the temperature sensor 50 for regulating power to the heater 10. The power controlling device 68 receives water presence data from the water presence sensor 84 and shuts off power to the water heater 10 in the absence of water within the heating chamber 20 and turns power on to the water heater 10 when the water presence sensor 84 detects water present within the heating chamber 20. The water presence sensor 84 can be a pressure switch 86 (shown in FIG. 6) or other device to sense the presence of water in the heater 10, such as a flow meter or vacuum switch. The power controlling device can employ electrical circuits, mechanical controlling means, or solid state technology controlling means.

Figure 6:
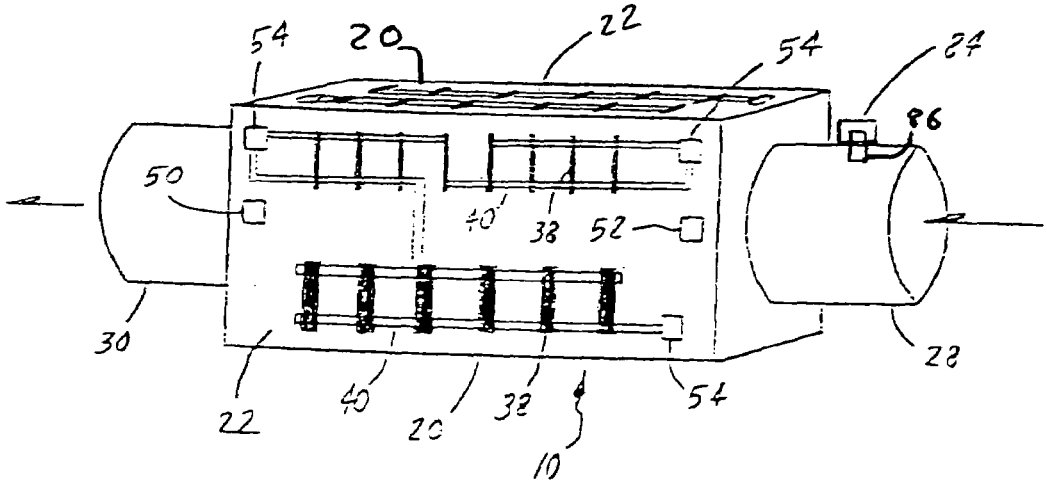
FIG. 6 is a perspective view of an embodiment of the water heater.

FIG. 6 is a perspective view of yet another alternate embodiment of the water heater 10, having a heating chamber 20 connected in a water flow path to heat the water flowing through the chamber. The heating chamber 20 has an inlet pipe 28 and an outlet pipe 30 for connecting the heater to a spa's plumbing lines and the electronic controls shown in FIG. 5. The embodiment shown has four rectangular thick film on substrate heaters with heating surfaces 22 to form four of the walls of the heating chamber 20. A separate water presence sensor 84 is shown as a pressure switch 86 located in the water flow path near the outlet pipe 30 and is connected to the electronic controller 56 for indicating the presence or absence of water in the heating chamber. The inlet pipe 28 and outlet pipe 30 are sized to fit preexisting spa plumbing lines. The advantage of the embodiment shown in FIG. 6 is that the layout of the resistive heating components can be configured to maximize heater surface to water interaction and produce less external heat thereby requiring less external insulation on the heater.

Additional temperature sensing devices can be used at the heater and/or in the spa plumbing to sense water temperature at various locations throughout the spa system. If the temperature sensor 40 is located within the water flow path it is generally potted in a potting compound such as epoxy or the like and in stainless steel housings. The stainless steel housings are mounted into the side of the heater inlet and/or outlet pipe with an insulating collar, which provides a water pressure seal and an insulative barrier from the heating chamber.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive; the scope of the invention being indicated by the appended claims, rather than the foregoing description, and all changes which come within the meaning and range of equivalency of the claims are therefore intended to be embraced therein.

What is claimed is:

1. A water heater system for use in spas, hot tubs, pools, hydrotherapy pools, bath tubs, and similar bodies of water used indoors, outdoors, or both indoors and outdoors, the water heater system comprising:

a water heater for heating a body of water to a desired temperature of approximately 90 degrees F. to 120 degrees F., the water heater comprising a heating chamber for heating water passing therethrough, the heating chamber comprising at least a portion of a recirculating water flow path and having an inlet, and outlet, and at least one heating surface fabricated of a metal material, the heating surface having an inner wet surface and an outer dry surface, wherein a dielectric layer is coupled to the outer dry surface of the at least one heating surface by a binding material formed on the outer dry surface of the heating chamber, at least one resistor is attached to the dielectric layer, a conductive layer is connected to at least a portion of the at least one resistor, and at least one terminal is connected to at least a portion of the conductive layer, and wherein the heating chamber includes a wall surface fabricated of a plastic or polyvinyl chloride (PVC) material;

at least one temperature sensor located on or near the water heater for sensing a temperature indicative of a water temperature;

at least one water presence sensor located on or near the heating chamber for sensing the presence or absence of water within the heating chamber;

at least one power controlling device, wherein the at least one power controlling device is connected to the at least one temperature sensor and the at least one water presence sensor; and wherein the power controlling device is configured to connect to a power supply for controllably energizing the water heater to regulate the temperature of the water heater and configured to control power to a pump for recirculating the water through the recirculating water flow path;

wherein the at least one power controlling device disconnects power to the water heater when the temperature sensed by the at least one temperature sensor exceeds a predetermined temperature and allows power to be reconnected to the water heater once the temperature has dropped below a predetermined temperature;

wherein the at least one power controlling device disconnects power to the water heater when the at least one water presence sensor detects the absence of water within the heating chamber and allows power to be reconnected to the water heater once the at least one water presence sensor senses water present within the heating chamber.

2. The water heater system according to claim 1, wherein the at least one power controlling device requires a manual reset after power to the water heater has been disconnected.

3. The water heater system according to claim 1, wherein the at least one power controlling device automatically reconnects power to the water heater after it has been disconnected.

4. The water heater system according to claim 1, wherein the at least one power controlling device has a high limit switch connected to the at least one temperature sensor and to the power supply for automatically causing the power to be disconnected from the water heater when the water temperature exceeds a predetermined temperature, the high limit switch requiring a manual reset once the water temperature has dropped below a predetermined temperature to allow power to be reconnected to the water heater.

5. The water heater system according to claim 1, wherein the at least one power controlling device has a high limit switch connected to the at least one temperature sensor and to the power supply for automatically causing the power to be disconnected from the water heater when the water temperature exceeds a predetermined temperature, the high limit switch automatically reconnecting the power supply once the water temperature has dropped below a predetermined temperature.

6. The water heater system according to claim 1, wherein the at least one heating surface comprises two heating surfaces.

7. The water heater system according to claim 1, wherein the at least one heating surface comprises three heating surfaces.

8. The water heater system according to claim 1, wherein the at least one heating surface comprises four heating surfaces.

9. The water heater system according to claim 1, wherein the at least one heating surface comprises a plurality of heating surfaces corresponding to the number of sides 'n' of a polygonal cross-section of the heating chamber.

10. The water heater system according to claim 1, wherein the at least one heating surface comprises a plurality of heating surfaces corresponding to the number 'n' minus one ('n−1'), wherein 'n' corresponds to the number of sides of a polygonal cross-section of the heating chamber.

11. The water heater system according to claim 1, wherein the at least one heating surface is stainless steel and the binding material is a chromium oxide coating formed on the outer surface of the heating surface as a result of the stainless steel being heated to a certain temperature.

12. The water heater system according to claim 1, further comprising an inlet pipe and an outlet pipe at the heating chamber inlet and outlet.

13. The water heater system according to claim 1, further comprising an insulating overcoat covering the dielectric layer, the at least one resistor and the conductive layer.

14. The water heater system according to claim 13, wherein the insulating overcoat comprises a glass insulating material.

15. The water heater system according to claim 1, wherein the at least one resistor is an electric resistance layer which is a product of depositing an electrically conductive composition onto the binding material.

16. The water heater system according to claim 1, wherein the at least one resistor is deposited in a pattern to provide one or more resistors.

17. The water heater system according to claim 1, wherein the at least one resistor is deposited by electrostatic spraying with the use of a stencil.

18. The water heater system according to claim 1, wherein the at least one resistor is screen-printed in a pattern to provide one or more resistors.

19. The water heater system according to claim 1, wherein the dielectric layer, at least one resistor, and conductive layer comprise at least one screen-printed thick film power resistor bonded to the binding material.

20. The water heater system according to claim 1, wherein the dimensions and layout of the dielectric layer, at least one resistor, and conductive layer depends on the size and the amount of the heat necessary to heat a spa, hot tub, pool, hydrotherapy pool, bath tub, or similar body of water used indoors, outdoors, or both indoors and outdoors.

21. The water heater system according to claim 1, wherein the at least one terminal is coupled to the conductive layer by multi-strand percussion welds.

22. The water heater system according to claim 1, wherein the at least one terminal is coupled to the conductive layer by a stud welded onto the conductive layer.

23. The water heater system according to claim 1, wherein the at least one temperature sensor is located within the heating chamber.

24. The water heater system according to claim 1, wherein the at least one temperature sensor is located within the recirculating water flow path on or near the inlet or outlet.

25. The water heater system according to claim 1, wherein the at least one temperature sensor comprises two temperature sensor devices located at a first and second separated location on or within the heating chamber.

26. The water heater system according to claim 1, wherein the at least one temperature sensor is a mechanical sensor such as bulb and capillary device.

27. The water heater system according to claim 1, wherein the water presence sensor is a pressure switch.

28. The water heater system according to claim 1, wherein the water presence sensor is a flow meter.

29. The water heater system according to claim 1, wherein the water presence sensor is a vacuum switch.

30. The water heater system according to claim 1, further comprising a grounding connection coupled to the water heater.

31. The water heater system according to claim 30, wherein the grounding connection comprises a clamp coupled to the at least one heating surface.

32. A recirculating water heating system for use in spas, hot tubs, pools, hydrotherapy pools, bath tubs, and similar bodies of water used indoors, outdoors, or both indoors and outdoors, the recirculating water heating system comprising:

a vessel for holding a body of water;

a pump for recirculating water from the vessel through a recirculating water flow path;

a water heater for heating a body of water to a desired temperature of approximately 90 degrees F. to 120 degrees F., the water heater comprising a heating chamber for heating water passing therethrough, the heating chamber comprising at least a portion of a recirculating water flow path and having an inlet, and outlet, and at least one heating surface fabricated of a metal material, the heating surface having an inner wet surface and an outer dry surface, wherein a dielectric layer is coupled to the outer dry surface of the at least one heating surface by a binding material formed on the outer dry surface of the heating chamber, at least one resistor is attached to the dielectric layer, a conductive layer is connected to at least a portion of the at least one resistor, and at least one terminal is connected to at least a portion of the conductive layer, and wherein the heating chamber includes a wall surface fabricated of a plastic or polyvinyl chloride (PVC) material;

at least one temperature sensor located on or near the water heater for sensing a temperature indicative of a water temperature;

at least one water presence sensor located on or near the heating chamber for sensing the presence or absence of water within the heating chamber;

at least one power controlling device, wherein the at least one power controlling device is connected to the at least one temperature sensor and the at least one water presence sensor; and wherein the power controlling device is configured to connect to a power supply for controllably energizing the water heater to regulate the temperature of the water heater and configured to control power to the recirculating pump for recirculating the water through the recirculating water flow path;

wherein the at least one power controlling device disconnects power to the water heater when the temperature sensed by the at least one temperature sensor exceeds a predetermined temperature and allows power to be reconnected to the water heater once the temperature has dropped below a predetermined temperature;

wherein the at least one power controlling device disconnects power to the water heater when the at least one water presence sensor detects the absence of water within the heating chamber and allows power to be reconnected to the water heater once the at least one water presence sensor senses water present within the heating chamber.

33. A recirculating water heating system for use in spas, hot tubs, pools, hydrotherapy pools and bath tubs, the recirculating water heating system comprising:

a vessel for holding water;

an electrically-powered water heater for heating a body of water to a desired temperature of approximately 90 degrees F. to 120 degrees F.;

a recirculating pump for recirculating water from the vessel through a recirculating water flow path to the water heater and back to the vessel;

the water heater comprising a heating chamber for heating water passing therethrough, the heating chamber comprising at least a portion of the recirculating water flow path and having an inlet, and outlet, and a heating surface fabricated of a metal material, the heating surface having an inner wet surface and an outer dry surface, wherein a dielectric layer is coupled to the outer dry surface of the heating surface by a binding material formed on the outer dry surface of the heating chamber, at least one resistor is attached to the dielectric layer, a conductive layer is connected to at least a portion of the at least one resistor, and at least one terminal is connected to at least a portion of the conductive whereas the heating chamber includes a wall surface fabricated of a plastic or polyvinyl chloride (PVC) material, layer;

a temperature sensor located on the water heater for sensing a temperature indicative of a water temperature;

a water presence sensor for sensing the presence or absence of water within the heating chamber;

a power controlling device connected to the temperature sensor and the water presence sensor, said power controlling device configured to connect to a power supply for controllably energizing the water heater to regulate the temperature of the water heater and configured to control power to the recirculating pump for recirculating the water through the recirculating water flow path.

34. The water heating system of claim 33, wherein the power controlling device disconnects power to the water heater when the temperature sensed by the temperature sensor exceeds a predetermined temperature and allows power to be reconnected to the water heater once the temperature has dropped below a predetermined temperature, and wherein the power controlling device disconnects power to the water heater when the water presence sensor detects the absence of water within the heating chamber and allows power to be reconnected to the water heater once the water presence sensor senses water present within the heating chamber.

35. The water heating system of claim 33, wherein all electrical elements of the water heater are located on said outer dry surface.

36. The water heating system of claim 35, wherein no electrical leads are passed within the heating chamber.

* * * * *